United States Patent [19]

Dudding

[11] Patent Number: 4,627,549

[45] Date of Patent: Dec. 9, 1986

[54] BULK CARGO CONTAINERS

[75] Inventor: Sheron L. Dudding, Brough, England

[73] Assignee: International Ferry Freight Limited, England

[21] Appl. No.: 842,299

[22] Filed: Mar. 21, 1986

[30] Foreign Application Priority Data

Mar. 28, 1985 [GB] United Kingdom ..... 8508132

[51] Int. Cl.[4] ..... B65D 7/26

[52] U.S. Cl. ..... 220/1.5; 49/168; 49/371

[58] Field of Search ..... 220/1.5, 1 V, 254, 255; 49/98, 104, 163, 168, 366, 371

[56] References Cited

U.S. PATENT DOCUMENTS

| | | | |
|---|---|---|---|
| 1,147,721 | 7/1915 | Harris et al. | 49/168 X |
| 1,410,565 | 3/1922 | Guerrant | 49/168 |
| 1,476,326 | 12/1923 | DeVilbiss | 49/371 X |
| 1,623,652 | 4/1927 | Bang | 49/371 X |
| 3,868,042 | 2/1975 | Bodenheimer | 220/1.5 X |
| 4,057,170 | 11/1977 | Dougherty | 220/1.5 X |
| 4,546,896 | 10/1985 | Reid | 220/1.5 X |

*Primary Examiner*—Steven M. Pollard

*Attorney, Agent, or Firm*—Pravel, Gambrell, Hewitt & Kimball

[57] ABSTRACT

A freight container for bulk and non-bulk cargoes comprising a substantially box-like structure with at least one hatch in the roof through which bulk cargo can be loaded and two main doors (4,5) to one end of the container through which non-bulk cargo can be loaded and unloaded. A latch (6) extends substantially the full width of the end of the container and is incorporated in one of the two main doors (4,5) through which bulk cargo can be unloaded.

6 Claims, 1 Drawing Figure

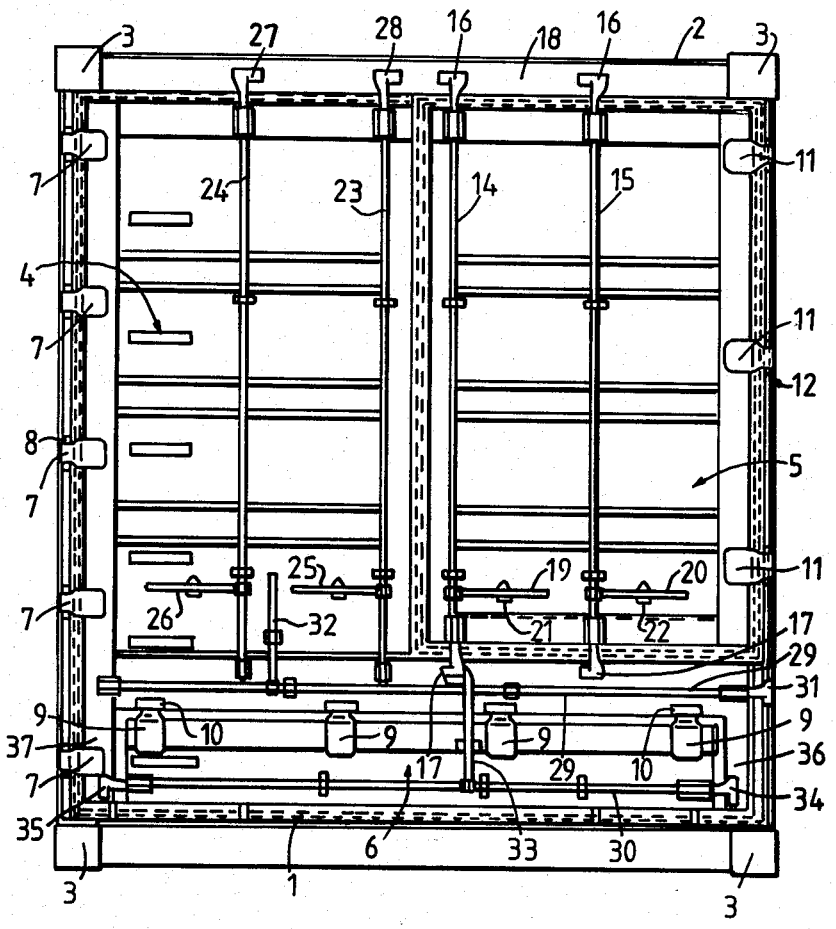
3
27
28
16
18
16
2
3
7
24
23
14
15
11
4
7
11
12
8
7
5
25
19
20
11
7
26
32
21
22
17
29
31
9
10
9
9
9
37
17
29
10
36
7
34
35
6
33
30
3
1
3

BULK CARGO CONTAINERS

DESCRIPTION

The present invention relates to containers and in particular to a container for bulk cargo for use with a tipping chassis.

A known bulk cargo container is adapted from a standard I.S.O. container which has two hinged doors at one end, by providing a plurality of roof hatches for loading purposes (e.g. four hatches) and a full width discharge hatch in the opposite end of the container to the main doors. For bulk cargoes the container is fitted with a special liner usually of polythene.

Such a container has the advantage that it can be used for carrying both bulk cargoes and, when the liner is removed, bagged products or such like by loading through the main doors.

A disadvantage of the known dual purpose container stems from the fact that the bulk discharge hatch is at the opposite end from the main doors. Thus the container has to be positioned the appropriate way round on the chassis depending on whether it is to carry bulk or bagged cargo. Unfortunately, if the container has just discharged a bulk cargo and is to be used for a bagged cargo for a return trip, it is necessary to turn the container round, not only to permit loading but also to enable the polythene liner to be removed. This involves taking the chassis and container to a lifting depot which may be some distance from the discharge site. A further problem is that the main doors may be inadvertently opened whilst a bulk cargo is present in the container with obvious consequences.

Thus, there is a requirement for a container which can be used to carry either bulk cargo or bagged cargo which overcomes the difficulties experienced with the known dual purpose containers.

According to the present invention then, there is provided a freight container comprising a substantially rectangular hollow box-like structure having one or more roof hatches for loading cargo in bulk form, two main doors at one end of the container for loading and unloading non-bulk cargo and a substantially full width bulk discharge hatch for discharging bulk cargo, characterised in that the bulk discharge hatch is incorporated in one of the two main doors.

By providing the discharge hatch at the same end as the main doors, the need to turn round the container is avoided. Furthermore, providing a full width discharge hatch reduces the obstruction during discharge and so provides a more efficient discharge and minimises the amount of cargo which is not discharged. This contrasts with the obvious alternative of providing a discharge hatch in the bottom of each of the two main doors, which would necessarily have an obstruction in the middle of the container where the two hatches are spaced apart by supporting framework.

Thus, one of the main doors is L-shaped with the bottom edge of the door being formed by the bulk discharge hatch. This permits the hatch to extend down to the floor level of the container. The bulk discharge hatch is arranged to be pivotally attached to the main door with the hinge being along the upper edge of the hatch.

Because the main doors and the bulk discharge hatch are located at the same end of the container it is possible to provide a mechanical interlock which prevents both the L-shaped door and the smaller rectangular one, from being opened when a bulk cargo is present. The interlock is dependent on the bulk discharge hatch being locked when a bulk cargo is present.

The present invention will now be described further, hereinafter by way of example only, with reference to the accompanying drawing which is an end view of a container according to the present invention.

The container according to the present invention comprises a substantially rectangular hollow box—much like the standard I.S.O. (International Standards Organisation) containers having a floor 1, four sides and a roof 2. Each corner of the container incorporates an I.S.O. corner casting 3 which serves to locate it on a chassis for transportation purposes. The container according to the present invention is a dual purpose container in as much as it can be used as a bulk cargo container or for carrying non-bulk cargo. The non-bulk cargo is loaded and unloaded by means of two main doors 4, 5 which form one end of the container.

The bulk cargo is conveniently loaded by means of one or more hatches disposed in the roof of the container. Four roof hatches may be provided in a 30 foot (9.15 meter) container. In order to discharge the bulk cargo a bulk discharge hatch 6 is provided in the end of the container. For discharge purposes the container is mounted on a tipping chassis—not illustrated.

In the container according to the present invention the two main doors 4, 5 and the bulk discharge hatch 6 are disposed at the same end of the container. This avoids having to turn round the container compared with the prior art dual purpose containers in which the main doors and the bulk discharge hatch are at opposite ends.

More specifically, the bulk discharge hatch 6 comprises part of the main door 4, the left hand door in the illustrated embodiment. For this purpose, the left hand door 4 is of L-shaped configuration, whilst the other door 5 (the right hand door) is substantially rectangular.

The left hand door 4 is hingedly connected to the left hand side of the container by suitable hinge means. Conveniently, this comprises five hinge members 7 journalled on a hinge bar 8. The bulk discharge hatch 6 is hingedly connected to the main door 4 so as to form a bottom opening flap which extends substantially the full width of the container. Four hinge members 9 are fixed to the hatch and are journalled on a or a respective hinge pin 10. The bottom edge of the hatch 6 terminates at the floor level of the container, or below, so that no obstruction is offered on discharge as there is no bottom edge supporting framework. The bulk discharge hatch 6 hinges upwardly.

The other main door 5 is hingedly connected to the right hand side of the container when viewed from what is the rear. This door is dimensioned to fit in the recess left by the L-shaped left hand door. It is provided with three hinge members 11 mounted on a hinge pin 12.

By virtue of the above described arrangement it is possible to load and unload non-bulk cargoes by opening the two main doors 4, 5 and inspection can be achieved by opening the smaller of the two doors. Bulk discharge is achieved by opening the hatch and connecting any appropriate discharge equipment. Because the discharge hatch extends the full width of the container, it provides the same or substantially the same discharge area as the known bulk containers whilst avoiding their disadvantages. A typical container has an internal width of 2.342 meters and the present invention provides a discharge opening width of 2.108 meters.

A system of mechanical locks are provided for the two main doors 4, 5 and the bulk discharge hatch 6. Each door has two vertical locking bars. The two vertical locking bars 14, 15 carried by the right hand door 5 are arranged to co-operate with respective catches 16, 17 above and below the door. The catches 16 are carried by a top frame member 18 whilst the catches 17 are carried by a part of the left hand door 4. The locking bars 14, 15 are rotated about their axis by respective handles 19, 20 in order to engage and disengage the bars with the catches. The handles themselves are pivotably attached to the bars and co-operate with respective latches 21, 22 to hold the handles and hence the bars in the closed position in engagement with the catches. Two similar locking bars 23, 24 are provided on the right hand door 4 and are actuable by handles 25, 26 to co-operate with catches 27, 28. The catches are only provided on the top frame member 18.

Two horizontal locking bars 29, 30 are also provided. The locking bar 29 is co-operable with a catch 31 on the right hand side of the container in order to locate the left hand door in a closed position. This bar 30 is actuated by a handle 32.

The other horizontal locking bar 30 serves to fasten and unfasten the bulk discharge hatch 6. It is rotated by a handle 33 and the opposite ends of the bar 30 co-operate with catches 34 and 35, both of which are located on side frame parts 36, 37 of the L-shaped door 4. The handle 33 has provision to be locked in its closed position and when in this position neither of the mechanisms controlling the unfastening of the left and right hand doors can be operated. This is because the handle 33 has an extension which overlies a flange on the horizontal bar 29 so preventing rotation of the bar 29, and secondly the bar 14 is held in the catch 17 when the handle 33 is in the locked position. Either the handle 33 covers the catch 17 or alternatively the bar 29 is provided with a flange to cover the catch 17.

By this mechanical interlock the main doors cannot be inadvertently opened when a bulk cargo is present in the container. It will be appreciated that a plastics liner is fitted into the container when bulk cargoes are carried to prevent leakage of the cargo.

What I claim is:

1. A freight container for bulk and non-bulk cargoes comprising a substantially rectangular hollow box-like structure having at least one opening therein through which a cargo in bulk form may be loaded, two main doors (4,5) at one end of the container through which non-bulk cargo may be loaded and unloaded and a substantially full width bulk discharge hatch (6) incorporated in one of the two main doors (4,5) through which bulk cargo may be unloaded.

2. A freight container according to claim 1, wherein the main door (5) incorporating said bulk discharge hatch (6) is substantially L-shaped with the bottom edge of the door (5) being formed by said bulk discharge hatch (6).

3. A freight container according to claim 1, wherein said bulk discharge hatch (6) is pivotally secured along its upper edge to the main door (5) in which it is incorporated.

4. A freight container according to claim 1, wherein a mechanical interlock (29,33) is provided to prevent the main doors (4,5) from being unlocked when a bulk cargo is present.

5. A freight container according to claim 4, wherein the interlock (29,33) is operated to prevent the main doors (4,5) from being unlocked before said bulk discharge hatch (6) is unlocked.

6. A freight container according to claim 1, wherein hatches are provided in the roof of the container through which bulk cargoes may be loaded into the container.

* * * * *